US009079287B2

(12) United States Patent
Lai et al.

(10) Patent No.: US 9,079,287 B2
(45) Date of Patent: Jul. 14, 2015

(54) CMP POLISHING PAD DETECTOR AND SYSTEM

(71) Applicant: MACRONIX INTERNATIONAL CO., LTD., Hsinchu (TW)

(72) Inventors: Ming Tsan Lai, Zhubei (TW); Yu Hua Yeh, Hsinchu (TW)

(73) Assignee: MACRONIX INTERNATIONAL CO., LTD. (TW)

( * ) Notice: Subject to any disclaimer, the term of this patent is extended or adjusted under 35 U.S.C. 154(b) by 0 days.

(21) Appl. No.: 14/044,509

(22) Filed: Oct. 2, 2013

(65) Prior Publication Data

US 2014/0273746 A1 Sep. 18, 2014

Related U.S. Application Data

(60) Provisional application No. 61/776,872, filed on Mar. 12, 2013.

(51) Int. Cl.
*B24B 37/005* (2012.01)
*B24B 49/12* (2006.01)

(52) U.S. Cl.
CPC ..... *B24B 37/005* (2013.01); *B24B 49/12* (2013.01)

(58) Field of Classification Search
CPC ..... B24B 49/12; B24B 53/017; B24B 1/04; B24B 37/20
USPC ..... 451/6, 8, 9, 443, 444, 56, 72, 41
See application file for complete search history.

(56) References Cited

U.S. PATENT DOCUMENTS

| | | | | |
|---|---|---|---|---|
| 6,609,962 | B1 * | 8/2003 | Wakabayashi et al. | 451/443 |
| 6,702,646 | B1 * | 3/2004 | Gitis et al. | 451/5 |
| 6,872,132 | B2 * | 3/2005 | Elledge et al. | 451/521 |
| 7,052,365 | B2 * | 5/2006 | Dornfeld et al. | 451/5 |
| 7,210,981 | B2 * | 5/2007 | Yilmaz et | 451/8 |
| 7,214,122 | B2 * | 5/2007 | Hirokawa et al. | 451/6 |
| 7,278,901 | B2 * | 10/2007 | Shin | 451/5 |
| 7,728,901 | B2 * | 6/2010 | Onozawa et al. | 348/340 |
| 8,296,961 | B2 * | 10/2012 | Nakayoshi et al. | 33/501.02 |
| 2012/0009847 | A1 * | 1/2012 | Menk et al. | 451/5 |

* cited by examiner

*Primary Examiner* — Monica Carter
*Assistant Examiner* — Lauren Beronja
(74) *Attorney, Agent, or Firm* — Baker & McKenzie LLP

(57) ABSTRACT

A chemical mechanical planarization apparatus includes a table, a polishing pad and a detector. The polishing pad is disposed at the table. The detector detects an abnormal condition of the polishing pad.

12 Claims, 3 Drawing Sheets

CMP POLISHING PAD DETECTOR AND SYSTEM

CROSS-REFERENCE TO RELATED APPLICATIONS

This application claims priority to U.S. Provisional App. Ser. No. 61/776,872, filed Mar. 12, 2013, which is hereby incorporated by reference in its entirety.

BACKGROUND

The present application relates generally to chemical mechanical planarization apparatus and includes methods and structures for detecting wear on chemical mechanical planarization components.

BRIEF SUMMARY

In an embodiment, a chemical mechanical planarization apparatus includes a table, a polishing pad and a detector. The polishing pad is disposed at the table. The detector detects an abnormal condition of the polishing pad.

In another embodiment, a method for detecting an abnormal condition in a chemical mechanical planarization process includes: providing a polishing pad to a region including a detector; detecting, with the detector, a presence or absence of the polishing pad at the detector; and generating an alarm signal when the absence of the polishing pad is detected.

DETAILED DESCRIPTION

Chemical mechanical planarization (CMP) processes include the use of a polishing pad in conjunction with a chemical or abrasive slurry to smooth the surface of a semiconductor wafer. If there is insufficient slurry on the wafer or if the polishing pad fails, then damage can be caused to the wafer.

Eventually, the polishing pad will wear out. For example, the pad may begin to peel off.

Figure 1:
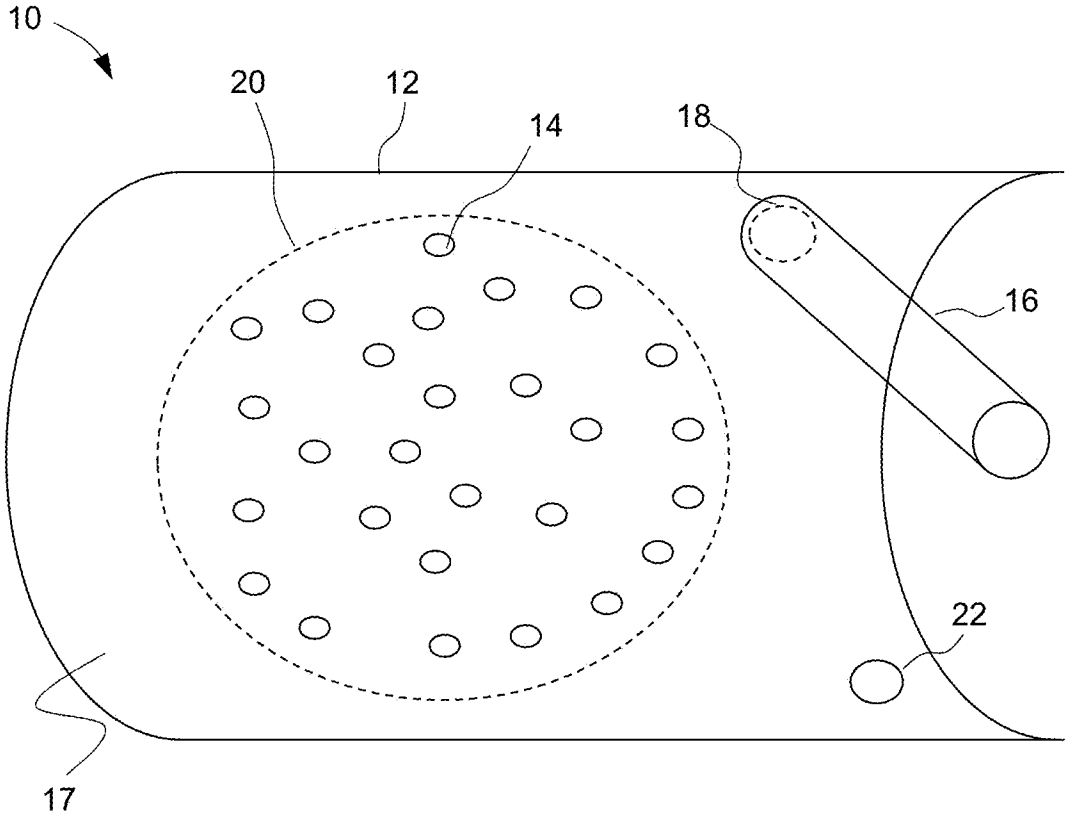
FIG. 1 is a top view of an exemplary chemical mechanical planarization apparatus.

FIG. 1 shows an exemplary chemical mechanical planarization (CMP) apparatus 10. The CMP apparatus 10 includes a buffing table 12 and an arm 16. The buffing table 12 may include a plurality of apertures 14 that are connected to a slurry system. The buffing table 12 and the arm 16 are coupled to a base structure such that the arm 16 may swing across the buffing table 12. The arm 16 carries a pad cleaner 18 across the buffing table 12 thereby allowing the pad cleaner 18 to perform work across the buffing pad 17 secured to the buffing table 12.

The buffing table 12 includes a region 20 corresponding to a region where a wafer is placed in the CMP apparatus 10 for processing. The buffing pad 17 may be applied to the buffing table 12. The region 20 may include some or all of the apertures 14 associated with a slurry system. The buffing table 12 may also include a sensor location 22. The sensor location 22 may be disposed outside of the region 20. The sensor location 22 may be disposed proximal to an outer edge of the buffing table 12 and at a side of the buffing table 12 proximal to a pivot associated with the arm 16. For example, the sensor location 22 may be provided between the region 20 and the edge of the buffing table 12 and may be provided on a portion of the buffing table 12 that protrudes away from the region 20. As another example, the buffing table 12 may have a non-circular shape with a pair of substantially parallel sides and a pair of arced sides, the arced sides including one convex arc and one concave arc. The sensor location 22 may be provided near a corner between one of the parallel sides and one of the arced sides.

A location for the sensor location 22 on the buffing table 12 as described above may be advantageous by disposing the sensor location 22 near a resting location of the pad cleaner 18. The pad cleaner 18 may be a brush that cleans a surface of the pad 17. The positioning of the sensor location 22 allows for quick and efficient testing of the pad 17 at the beginning and end of a processing cycle. the pad cleaner 18 may be moved off of the wafer and out of the region 20 to pass over the sensor location 22 as well as across the region 20. This allows for similar wear to the pad 17 at the sensing location 22 as well as within the region 20. The testing may be conducted while the wafer is being processed. The pad 17 may wear more quickly and begin peeling near an edge. Thus, providing the sensor location 22 near an edge of the buffing table 12 may provide for detection of wear on the pad 17 before it is excessively worn in the region 20. It will be appreciated that this arrangement is exemplary in nature and other arrangements and locations for the sensor location 22 are also contemplated. For example, the pad 17 may be carried by the arm 16 across a wafer secured to the buffing table 12. In such an example, the pad 17 may be carried by the arm 16 to the sensing location 22 for testing while processing of the wafer is underway.

Figure 2:
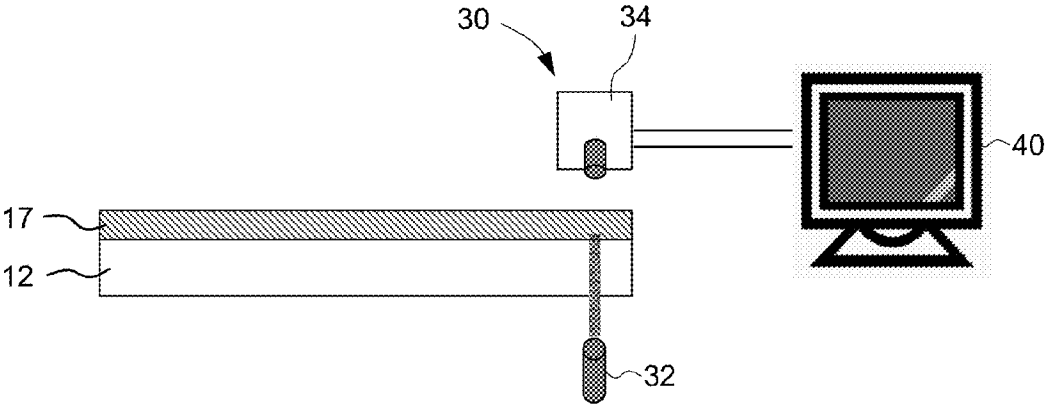
FIG. 2 is side view of an exemplary chemical mechanical planarization pad detector in a normal condition.

Referring to FIG. 2, a detector 30 includes an emitter 32 and a receiver 34. The detector 30 may be, for example, a photo detector with the emitter 32 providing a light source and the receiver 34 detecting light emitted by the light source. The emitter may be positioned below the buffing table 12 at the sensor location 22. A through hole may be provided in the buffing table 12 to allow emissions from the emitter 32 to pass through the buffing table 12 at the sensor location 22. The receiver 34 may be positioned above the buffing table 12 at the sensor location 22.

It will be appreciated that this arrangement is exemplary in nature and other arrangements may also be used. For example, the emitter 32 may be placed above the buffing table 12 and the receiver 34 placed below the buffing table 12. As another example, the emitter 32 and the receiver 34 may be placed on the same side of the buffing table 12 and a reflecting surface may be provided below, on, or as a part of the buffing table 12. As still another example, an optical system may be used to place the emitter 32 and the receiver 34 at a desired position with various orientations.

In the example shown in FIG. 2, the pad 17 is in good condition. The pad 17 blocks the emissions from the emitter 32 from reaching the receiver 34. A control system 40 operatively coupled to the emitter 32 provides a normal readout.

Figure 3:
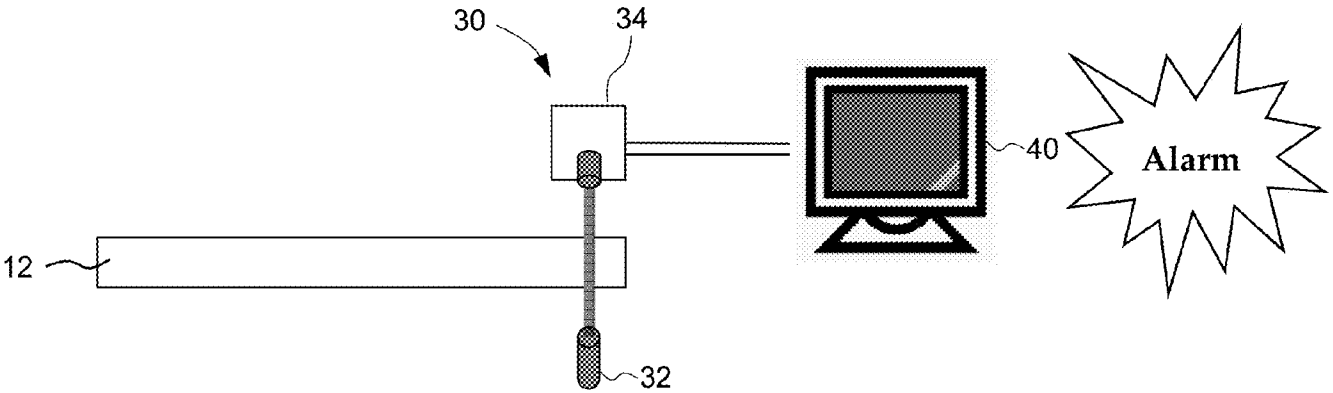
FIG. 3 is a side view of an exemplary chemical mechanical planarization pad detector in an alarm condition.

Referring now to FIG. 3, the emissions from the emitter 32 reach the receiver 34 because the pad 17 is in an abnormal condition and completely or partially missing. The control system 40 provides an alarm readout.

Figure 4:
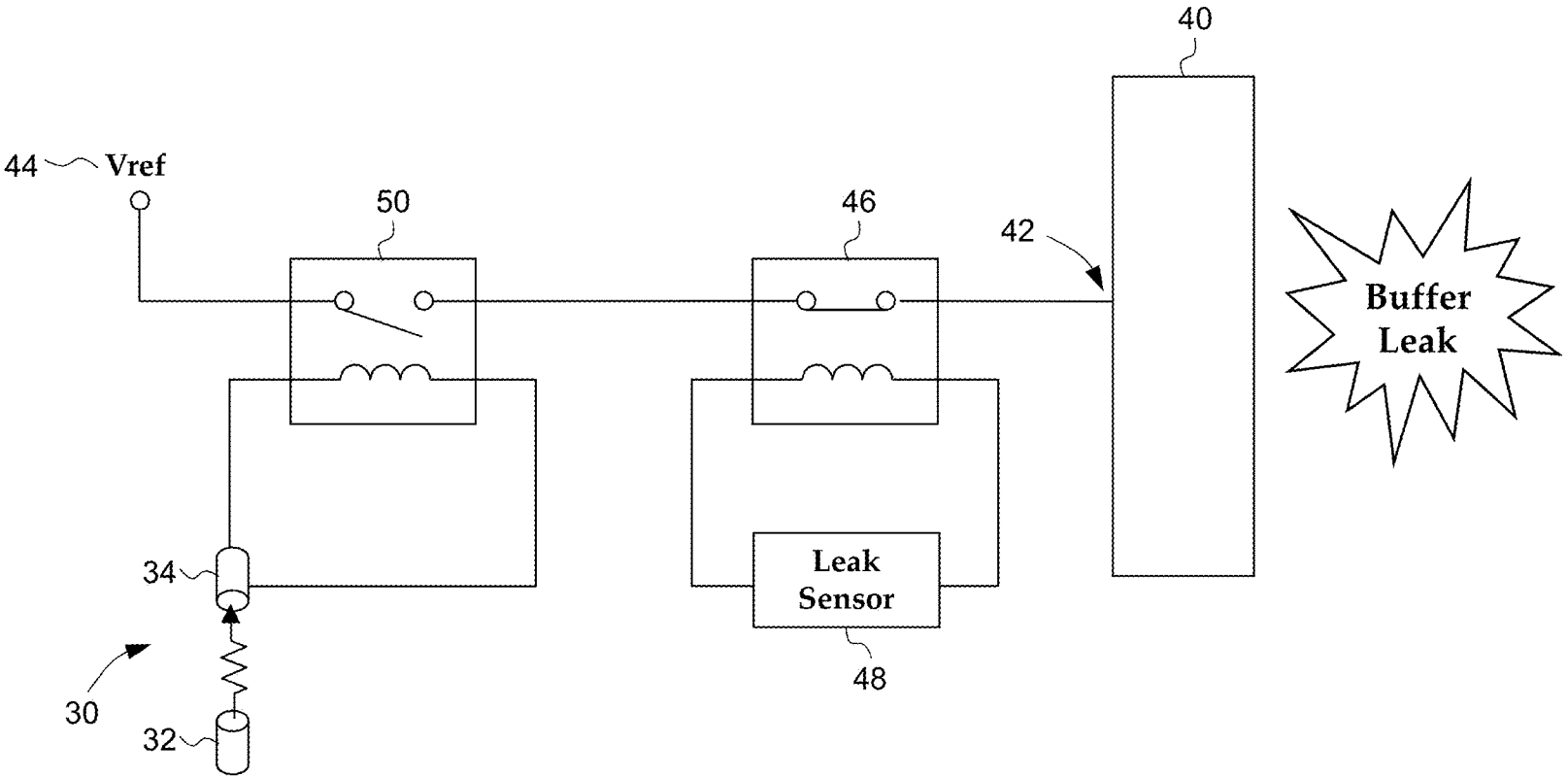
FIG. 4 is a schematic view of an exemplary circuit for detecting a condition of a chemical mechanical planarization apparatus.

FIG. 4 shows an exemplary circuit for coupling the detector 30 to a control system 40 for a CMP apparatus that was not manufactured with a provision for the detector 30. The control system 40 may already have an input 42 for a leak sensor. A leak sensor may be provided to detect a leak of water or slurry. The control system 40 may be configured to stop processing and announce a buffer leak error when the leak is detected. In normal operation, a reference voltage 44 is provided to the input 42 via the normally connected relay 46. In the event of a leak detection, the leak sensor 48 energizes the coil of the relay 46 and opens the circuit. The control system 40 may detect the presence of a leak by the absence of the reference voltage at the input 42.

To also provide for the detector 30, a relay 50 is provided in serial with the relay 46 between the reference voltage 44 and the input 42. When the detector 30 detects a failure in the polishing pad, the coil of the relay 50 is energized and opens the circuit. Thus, the control system 40 announces an error when the detector 30 detects a failure in the polishing pad.

It will be appreciated that the above-described circuit merely exemplary in nature and a variety of other circuits may also be used. For example, the control system may include separate inputs for the pad detector and leak detector or the control system may not include a leak detector. A normally open arrangement with parallel relays may also be used, as could a variety of pull-down or pull-up circuits.

While various embodiments in accordance with the disclosed principles have been described above, it should be understood that they have been presented by way of example only, and are not limiting. Thus, the breadth and scope of the invention(s) should not be limited by any of the above-described exemplary embodiments, but should be defined only in accordance with the claims and their equivalents issuing from this disclosure. Furthermore, the above advantages and features are provided in described embodiments, but shall not limit the application of such issued claims to processes and structures accomplishing any or all of the above advantages.

Additionally, the section headings herein are provided for consistency with the suggestions under 37 C.F.R. 1.77 or otherwise to provide organizational cues. These headings shall not limit or characterize the invention(s) set out in any claims that may issue from this disclosure. Specifically and by way of example, a description of a technology in the "Background" is not to be construed as an admission that technology is prior art to any invention(s) in this disclosure. Neither is the "Summary" to be considered as a characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings set forth herein.

What is claimed is:

1. A chemical mechanical planarization apparatus, comprising:

a table that secures a wafer;

a polishing pad disposed at the table; and a detector that detects an abnormal condition of the polishing pad, wherein the detector includes an emitter and a receiver, the emitter is disposed below the table, the receiver is disposed above the table, the table includes a through hole, and the emitter and receiver are disposed such that emissions from the emitter pass through the through hole and to the receiver.

2. The apparatus of claim 1, wherein the detector is configured to generate a signal representing the abnormal condition when the receiver does not receive emissions from the emitter.

3. The apparatus of claim 2, further comprising a leak detector that generates a signal representing an alarm state, the signal from the leak detector being provided to a first relay, wherein the signal from the detector is provided to a second relay, and the first and second relays are arranged in a serial combination and in communication with an input of a control system.

4. The apparatus of claim 2, further comprising a leak detector that generates a signal representing an alarm state, the signal from the leak detector being provided to a first relay, wherein the signal from the detector is provided to a second relay, and the first and second relays are arranged in a parallel combination and in communication with an input of a control system.

5. The apparatus of claim 1, further comprising a controller configured to stop a planarization process when the detector detects the abnormal condition of the polishing pad.

6. The apparatus of claim 1, wherein the table includes a region that accommodates the wafer, and the detector is configured to perform the detection at a location outside the region.

7. The apparatus of claim 1, wherein the table includes a first side having a convex arc, a second side having a concave arc, and a third side, and the detector is configured to perform the detection proximal to a corner defined by the third side and one of the first side and the second side.

8. The apparatus of claim 1, further comprising a brush that cleans the polishing pad.

9. A method for detecting an abnormal condition in a chemical mechanical planarization process, comprising:

providing a polishing pad to a region including a detector;

detecting, with the detector, a presence or absence of the polishing pad at the detector; and generating an alarm signal when the absence of the polishing pad is detected, wherein the step detecting includes emitting an emission from an emitter and determining whether the emission is received by a receiver, and the emitter is disposed below a table and the receiver is disposed above the table.

10. The method of claim 9, wherein the table includes a first side having a convex arc, a second side having a concave arc, and a third side, and the emitter and receiver is configured to perform the detection proximal to a corner defined by the third side and one of the first side and the second side.

11. The method of claim 9, further comprising:

receiving the alarm signal at a control system; and stopping the chemical mechanical planarization process after the alarm signal is received.

12. The method of claim 9, wherein the table includes a through hole, and the emitter and receiver are disposed such that emissions from the emitter pass through the through hole and to the receiver.

* * * * *